US008480457B2

(12) United States Patent
Kundel, Jr.

(10) Patent No.: US 8,480,457 B2
(45) Date of Patent: Jul. 9, 2013

(54) SURFACE PREPARATION APPARATUS

(76) Inventor: Robert Kundel, Jr., Austintown, OH (US)

( * ) Notice: Subject to any disclaimer, the term of this patent is extended or adjusted under 35 U.S.C. 154(b) by 428 days.

(21) Appl. No.: 12/970,920

(22) Filed: Dec. 16, 2010

(65) Prior Publication Data

US 2012/0156974 A1 Jun. 21, 2012

(51) Int. Cl.
*B24B 23/02* (2006.01)

(52) U.S. Cl.
USPC ..... 451/340; 451/357; 451/358; 451/456; 15/23; 15/52.1; 15/327.2; 83/100

(58) Field of Classification Search
USPC ..... 451/357, 358, 359, 451–457; 83/167, 83/440.2, 544–546, 814–819, 100, 109, 162, 83/478; 15/198, 93.1, 23, 52.1, 327.2, 344, 15/383, 246.2, 378, 415.1; 30/124
See application file for complete search history.

(56) References Cited

U.S. PATENT DOCUMENTS 1,063,559 A * 6/1913 Long ..... 15/383
1,087,068 A * 2/1914 Lueck ..... 30/476
1,267,282 A * 5/1918 Scully ..... 15/385
1,648,888 A * 11/1927 Aurand ..... 29/81.05
1,553,059 A 3/1928 Peterson
1,616,054 A 7/1931 Pelkey
1,874,220 A 8/1932 Aurand
2,001,099 A * 5/1935 Holt ..... 451/352
2,085,202 A * 6/1937 Sauer ..... 407/29.13
2,120,252 A * 6/1938 Kadri ..... 451/358
2,303,089 A * 11/1942 Peterson ..... 15/366
2,548,923 A * 4/1951 Walters et al. ..... 15/24
D166,304 S 4/1952 Falls
D166,305 S 4/1952 Falls
3,034,493 A * 5/1962 Bandy ..... 125/13.01
3,101,524 A * 8/1963 Falls ..... 29/81.05
3,368,635 A * 2/1968 Harman ..... 173/215
3,468,073 A * 9/1969 Del Vecchio ..... 451/358
3,585,980 A * 6/1971 Mellor ..... 125/13.01
3,914,905 A * 10/1975 Waters ..... 451/358
3,964,212 A * 6/1976 Karden ..... 451/358
4,052,824 A * 10/1977 Hutchins ..... 451/357
4,598,500 A * 7/1986 Faraudo et al. ..... 451/456
D305,721 S 1/1990 Fushiya et al.
4,948,307 A * 8/1990 Dodds ..... 409/136
4,993,192 A * 2/1991 Demetrius ..... 451/358
5,297,363 A 3/1994 Schroder et al.
5,595,532 A * 1/1997 McCracken ..... 451/357
5,727,995 A 3/1998 Harkins et al.
6,375,557 B1 * 4/2002 Spangenberg et al. ..... 451/344
6,592,441 B2 * 7/2003 McCracken et al. ..... 451/357

(Continued)

OTHER PUBLICATIONS http://www.aurand.net/aurandweb/site/index.php, downloaded Dec. 16, 2010, 2 pgs.

(Continued)

*Primary Examiner* — George Nguyen

(57) ABSTRACT

A hand-held surface preparation apparatus comprising a frame, a hollow semi-circular shaped housing member connected to said frame, a drive housing connected to said housing member, a motor secured to said drive housing aligned directly over said hollow semi-circular shaped housing member, a roller rotatably positioned inside of the semi-circular shaped housing member in communication with said motor, front and rear guide handles extending from said frame, and removably connected front and rear debris guards.

9 Claims, 5 Drawing Sheets

U.S. PATENT DOCUMENTS

| | | | | |
|---|---|---|---|---|
| 6,648,742 | B1 * | 11/2003 | Segiel, Jr. | 451/451 |
| 6,699,114 | B1 * | 3/2004 | Booeshaghi et al. | 451/451 |
| 6,802,766 | B2 * | 10/2004 | Liu | 451/451 |
| 6,921,438 | B2 * | 7/2005 | Lausevic | 134/21 |
| 6,953,394 | B2 * | 10/2005 | Wendt et al. | 451/352 |
| 6,971,951 | B2 * | 12/2005 | Boyer | 451/344 |
| 6,979,373 | B1 * | 12/2005 | Rogers | 134/21 |
| 7,018,280 | B2 * | 3/2006 | Walker | 451/355 |
| 7,033,259 | B1 * | 4/2006 | Seasholtz et al. | 451/354 |
| 7,216,396 | B2 * | 5/2007 | Slawinski | 15/301 |
| 7,300,339 | B2 * | 11/2007 | Gaul et al. | 451/451 |
| 7,478,457 | B2 * | 1/2009 | Kertz | 15/387 |
| 7,713,110 | B2 * | 5/2010 | Lampka et al. | 451/357 |
| 7,980,924 | B2 * | 7/2011 | Blatz | 451/456 |
| 8,006,648 | B1 * | 8/2011 | Sourwine | 119/609 |
| 8,011,357 | B2 * | 9/2011 | Johansson | 30/124 |
| 8,388,415 | B2 * | 3/2013 | Soika et al. | 451/178 |
| 2004/0216269 | A1 * | 11/2004 | Slawinski | 15/415.1 |
| 2007/0093189 | A1 * | 4/2007 | Gaul et al. | 451/451 |
| 2008/0121080 | A1 * | 5/2008 | Liu et al. | 83/397 |
| 2008/0163492 | A1 * | 7/2008 | Johansson | 30/124 |
| 2010/0144251 | A1 * | 6/2010 | Farrell | 451/358 |

OTHER PUBLICATIONS http://www.festool.co.uk/Products/Pages/Product-Detail.aspx?pid=570748&name=RUSTOFIX-RAS-180-03-E-HR-GB-240V, downloaded Dec. 16, 2010, 1 pg.

http://www.makita.com/en-us/Modules/Tools/ToolDetails.aspx?ID=414, downloaded Dec. 16, 2010, 1 pg.

* cited by examiner

SURFACE PREPARATION APPARATUS

BACKGROUND OF THE INVENTION

The present invention is directed to a hand-held surface preparation apparatus housing a task-specific roller mounted directly under an angle grind motor and having a vacuum capable handle connected thereto. The present invention is also directed to a means for providing removable debris guards on said apparatus.

There is a substantial need for surface preparation in industrial, commercial and residential applications. Specifically, a number of surfaces, such as steel, aluminum, stone, tile, concrete, wood, plastic and any painted, rusted, or corroded surfaces require surface preparation. The surface preparation could include stripping, polishing, cleaning, sanding, buffing, or grinding.

There are a wide variety of hand-held tools currently on the market which grind, sand, buff or polish surfaces. However, these tools are unbalanced, have a very limited range of motion and generally cause arm and side torque for the user. These tools further cover only a limited surface area and are unable to properly contour to rounded or uneven surface shapes. Specifically, they can only be used on flat services.

DESCRIPTION OF PRIOR ART

Typical grinders and sanders available, such as the Makita® 9741 Wheel Sander and the FESTOOL® Rustofix™, have motors that are located to the rear and side of the devices, respectively. When the user is attempting to prepare a desired surface by, for example, grinding or sanding, the devices have a tendency to shift in the direction of the motor and or sanding disc. This puts undue torque on the users' side and arms. Specifically, the Makita® Wheel Sander is unbalanced as the motor is located in the rear and causes the user to put extra pressure to keep the sanding disc in line with the surface. It also does not have a vacuum attachment and will only work on flat surfaces. The FESTOOL® Rustofix™ is unbalanced as the motor is connected to the side of the apparatus, which causes the apparatus to rotate away from the contact surface and requires the user to exert additional force to maintain contact with the surface.

Other prior art examples of power abrasive cleaning devices can be seen in U.S. Pat. Nos. 1,663,059, 5,727,995, D166,304 and D166,305.

U.S. Pat. No. 1,663,059 discloses a cleaning and abrasive device that can be seen as having a gear driven cleaning member powered by a motor from which a handle extends longitudinally.

U.S. Pat. No. 5,727,995 is directed towards a rotary preening tool having a pneumatic motor driving a preening flat assembly within a shroud having a vacuum attachment extending therefrom.

Design Pat. Nos. 166,304 and 166,305 illustrate cleaning tools having cylindrical material engagement brushes driven by a longitudinal offset motor configuration within support engagement handles.

For the foregoing reasons, there is a need for an apparatus that can prepare surfaces by grinding, sanding, buffing, cleaning, stripping and/or polishing, which is easy to handle and maneuver, covers a larger and varied surface area, protects the user from flying debris and has a means for eliminating said debris.

BRIEF SUMMARY OF THE INVENTION

The primary object of the present invention is to provide a hand-held apparatus for preparing a variety of surfaces which is easy to maneuver, has a balanced design to provide ease of use, and contours easily to non-flat surfaces. This invention is also directed to an apparatus having a vacuum handle to provide an optional means for eliminating waste material or debris generated by said preparation. This invention is further directed to an apparatus having an adjustable debris guard to protect the user.

The present invention comprises an apparatus designed to house a task-specific roller. This invention further comprises a means for mounting an angle grinder motor directly on top of the desired roller. The invention also comprises a vacuum handle which can be connected to a vacuum, such as a shop vacuum or a canister vacuum, in order to remove unwanted debris from the surface area. Another embodiment of the present invention would be to provide a pivoting debris guard removably attached to said apparatus.

Unlike standard hand-held grinding and sanding tools currently on the market, the motor of the subject apparatus is located directly above the roller. This feature makes it easier for the user to maneuver the apparatus as it provides for a more balanced tool. For example, in a typical angle grinder, the angle grinding disc is located to the right motor. When the grinder is in use, it is being pulled in the direction of the motor and may cause the user to lose their grip. This results in loss of contact with the surface area or uneven contact as the user is continually twisting their arm to accommodate for the extra pull. This alignment further reduces the contact surface area. The balanced design of the present apparatus means the user does not have to rely on arm strength or reaction time to ensure full contact with the surface being prepared. It further keeps the apparatus compact and greatly increases the range of motion on the surface area.

The subject apparatus can be powered by a variety of means, such as an electric motor, a combustion engine or compressed air.

The present apparatus is further designed to work with a variety of rollers to accomplish specific tasks. Examples of available rotary cylinder brushes and rollers can be found on the world wide web at, for example, finzerroller.com/solutions_brush_tech.php and widdops.com/products/industrial-roller-brushes.html. For the purpose of the present invention, the term "roller" will be used to describe the many different roller and brush attachments that can be used with the subject apparatus. Any type of roller or brush can be coupled to this apparatus to fulfill the desired task for the user.

The vacuum capable handle on the subject apparatus is designed to allow the user to connect a standard vacuum line. It is also designed to provide an adaptor to fit any sized vacuum line to the handle and to allow the user to place an end cap thereon when use of a vacuum line is not desired. The vacuum capable handle also provides an additional means for steadying and guiding the apparatus around the desired surface. Specifically, the additional handle makes it easier to guide the apparatus along uneven or rounded surfaces.

Removable debris guards are also provided on the apparatus at the rearground and foreground. The rear debris guard is preferably made of rubber in order to adjustably accommodate the surface, without scratching or marring said surface. The front guard is provided as a means for protecting the user and storing the debris for vacuum removal. The front debris guard is further designed to pivot at a desired angle in order to accommodate rounded and uneven surfaces.

The location of the motor directly on top of the roller, the positions of the guide and vacuum handles, as well as the pivotal alignment of front debris guard allows the apparatus to work on a variety of surface shapes. Standard angle grinders on the market easily lose contact with the preparation surface when rounded or uneven surfaces are encountered. The degree of control enabled by the subject apparatus allows the user to easily maintain continued contact with a variety of surface shapes.

BRIEF DESCRIPTION OF THE DRAWINGS

It is to be understood that the drawings are designed for the purpose of illustration only and not as a definition of the limits of the instant invention, for which reference should be made to the claims appended hereto. Other features, objects and advantages of this invention will become clear from the detailed description made with reference to the following drawings:

DETAILED DESCRIPTION OF THE INVENTION

Figure 1:
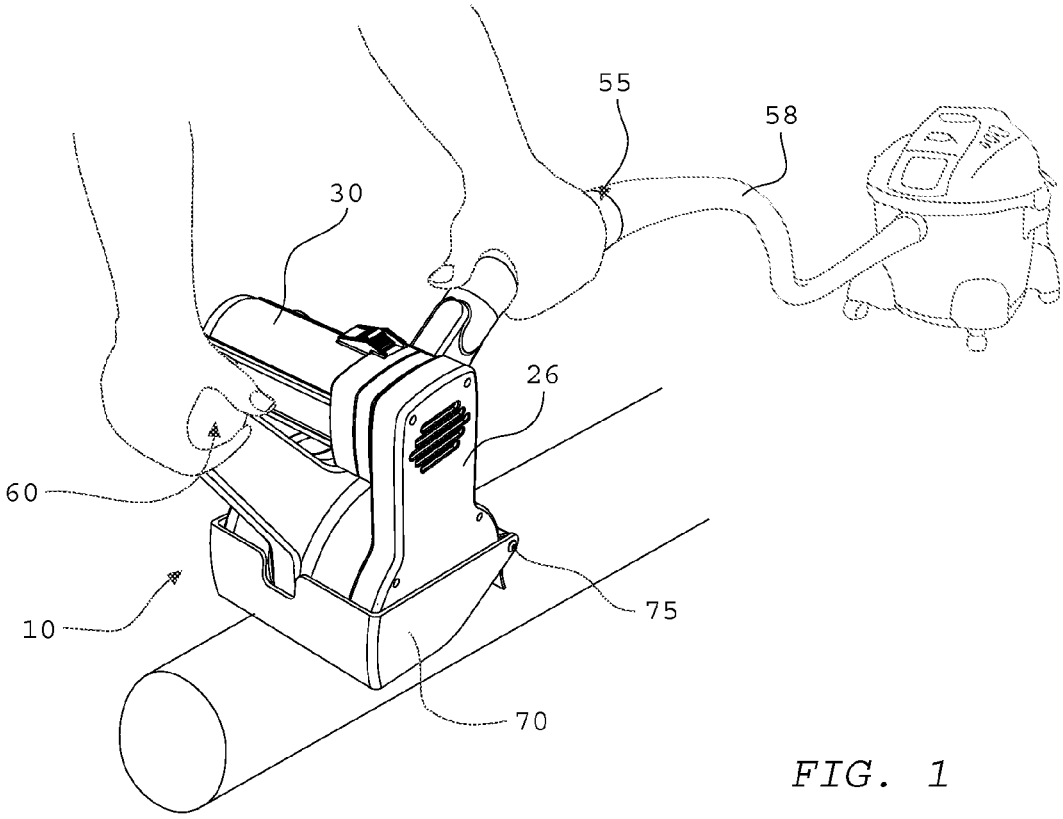
FIG. 1 is a front perspective view showing the apparatus of the present invention in use.

The present invention is directed to an apparatus (10) comprised of a frame (20) for housing a motor (30) and a roller (40) as shown in FIG. 1. The present invention further comprises a vacuum capable handle (50), a guide handle (60) and two removable debris guards (70, 80) designed to protect the user and deflect surface waste, as shown in FIGS. 2 and 3.

Attached to the frame (20) is the vacuum capable handle (50), the guide handle (60), as well as a hollow semi-circular shaped housing member (90) to house a cylindrical roller (40). The frame (20) could be constructed, for example, out of plastic, aluminum or steel. However the subject invention should not be limited to these materials. The frame components could be attached to the frame by means of bolts, fasteners, latches, welding, or the like.

Figure 2:
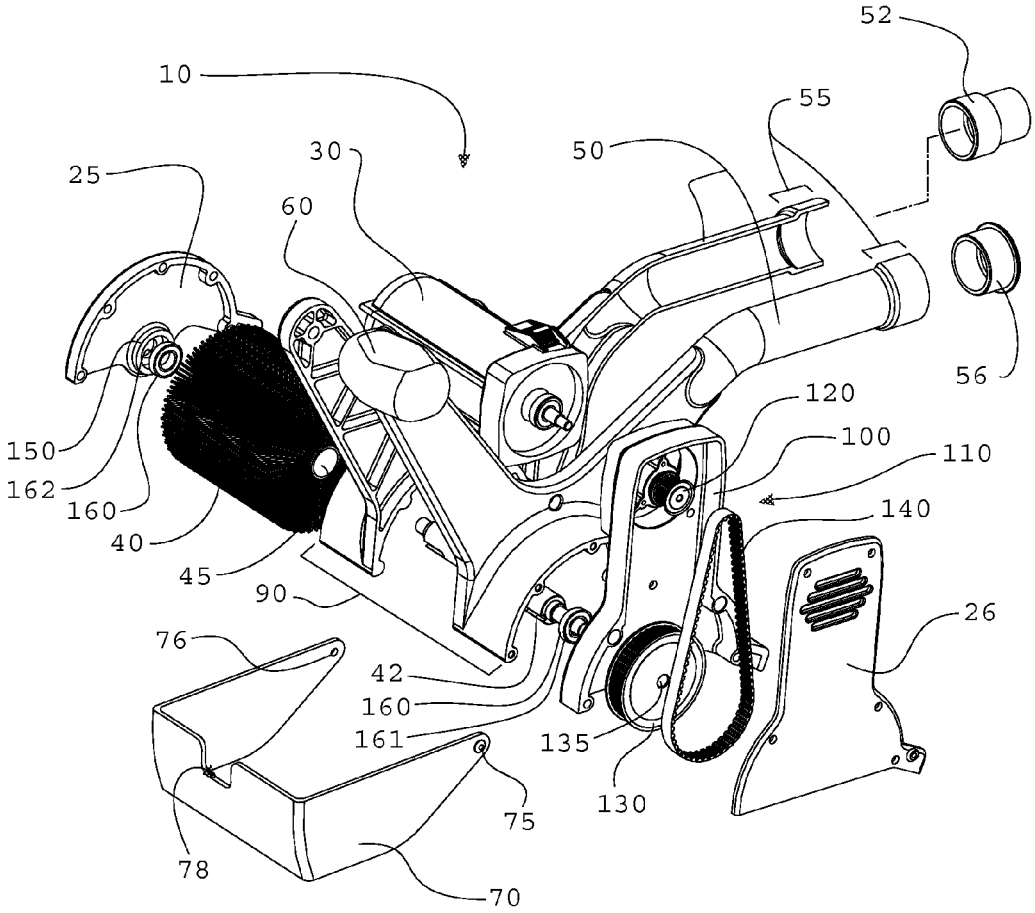
FIG. 2 is an exploded view thereof as shown in FIG. 1.
Figure 3:
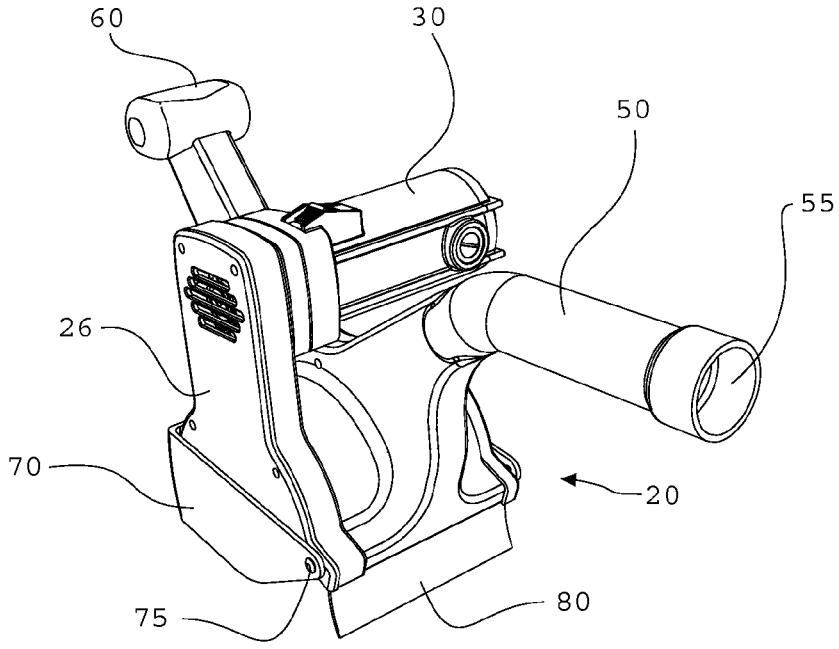
FIG. 3 is a perspective view showing the structure of the claimed invention.

As shown in FIG. 2, the motor (30) is connected to the frame (20) so that it is positioned directly on top of the semi-circular shaped housing member (90) and roller (40). The motor (30) could be attached to the frame (20) by a variety of means, such as bolts, fasteners, welding.

A drive housing (100) encloses the drive components, which is comprised of a pulley system (110) and a timing belt (140), as sown in FIG. 2. The pulley system is comprised of a drive pulley (120), which is connected to the motor (30), and a roller pulley (130), which is connected to the roller (40). A bearing holder (150) is located on the frame (20) at the opposite end of the roller pulley (130).

The roller (40) is removably connected to the hollow inside of the semi-circular shaped housing member (90) as shown in FIG. 2. A shaft (42) having bearing ends (161, 162) is located inside of the hollow center (45) of the roller (40). In one embodiment, the roller (40) is attached to the frame by inserting one end of the bearing (161) into a bearing holder (150) and inserting the opposite end of the bearing (162) into an opening (135) in the center of the roller pulley (130). In another embodiment, the roller (40) can be attached to the frame by means of fasteners or latches.

In the present embodiment, the roller (40) is powered by the motor (30) using a pulley system connected to a timing belt drive. Another embodiment of the present invention would power the roller (40) by, for example, interlocking gears powered by the motor (30). However, the method of putting the roller (40) into motion should not be limited to the methods listed herein.

When the motor (30) is engaged or switched to the "on" position, the roller (40) will be put into motion by the pulley system (110). Specifically, the drive pulley (120) will be rotated by the motor (30). The drive pulley (120) will then rotate the attached timing belt (140). The timing belt (140) will rotate the roller pulley (130), and in turn the opening (135) of the roller pulley (130) that houses one end of the bearing (162). This will engage the bearing (160) located inside the roller and rotate the roller (40) at the desired speed and direction.

The apparatus (10) is maneuvered by means of a guide handle (60), which is connected to the frame (20) at the dorsal end of the frame, as shown in FIG. 1. In the preferred embodiment, the guide handle (60) would be adjustable to the desired angle thereby permitting the orientation of the guide handle to be optimized to a desired guide handle height. Alternate embodiments of the guide handle (60) could include T-shaped, U-shaped, Y-shaped or V-shaped handle members.

Situated opposite the guide handle (60) on the frame (20) is a rigid vacuum capable handle (50) which is also connected to the frame (20) as shown in FIG. 3. The distal end (55) of the vacuum capable handle (50) could be 1¼ to 2½ inches in diameter in order to accommodate a vacuum line (58) being fitted thereto, as shown in FIG. 1. In the preferred embodiment, the distal end of the vacuum capable handle (55) would be 2½ inches in diameter and would have a rubber adaptor (52) to accommodate smaller vacuum lines, as shown in FIG. 2. The vacuum may be any type vacuum known to those of skill in the art, such as a standard shop vacuum or home canister vacuum.

Figure 4:
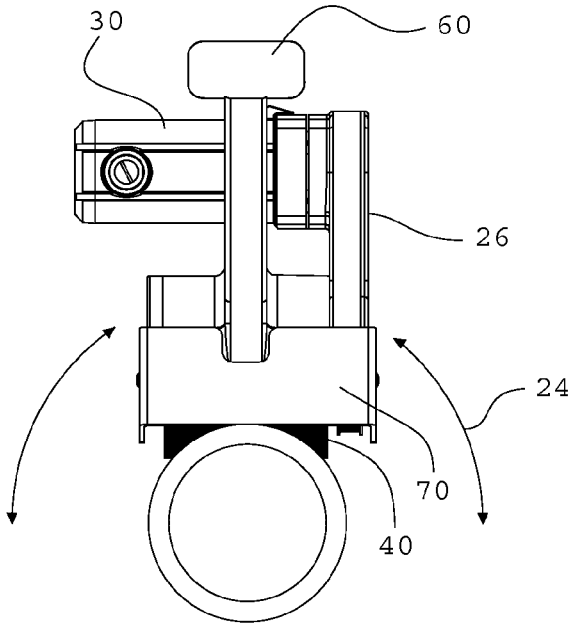
FIG. 4 is a front elevational view of the apparatus shown in FIG. 1, being used on a curved surface.
Figure 5:
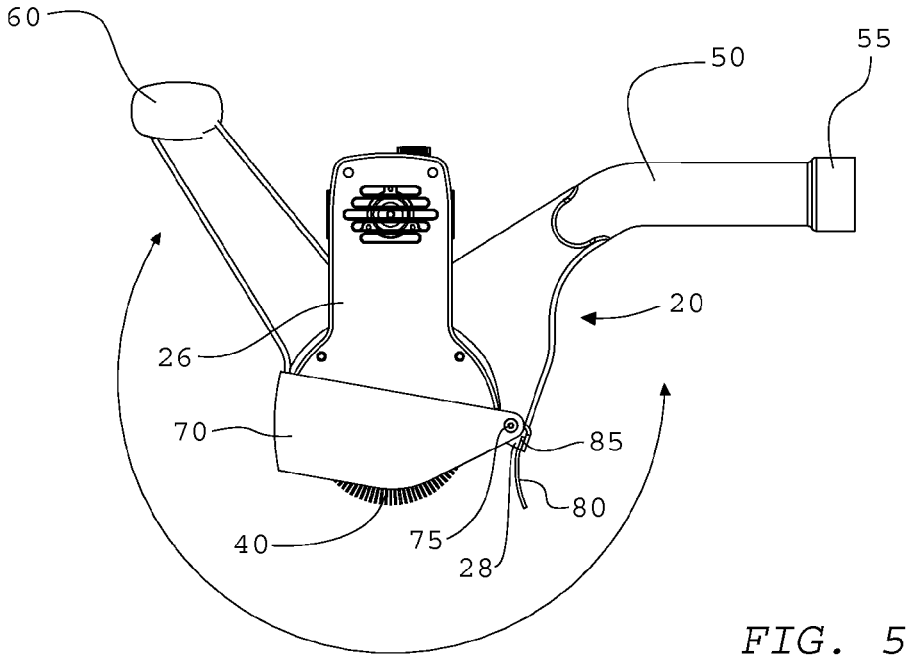
FIG. 5 is a right side elevational view of the apparatus shown in FIG. 1.
Figure 6:
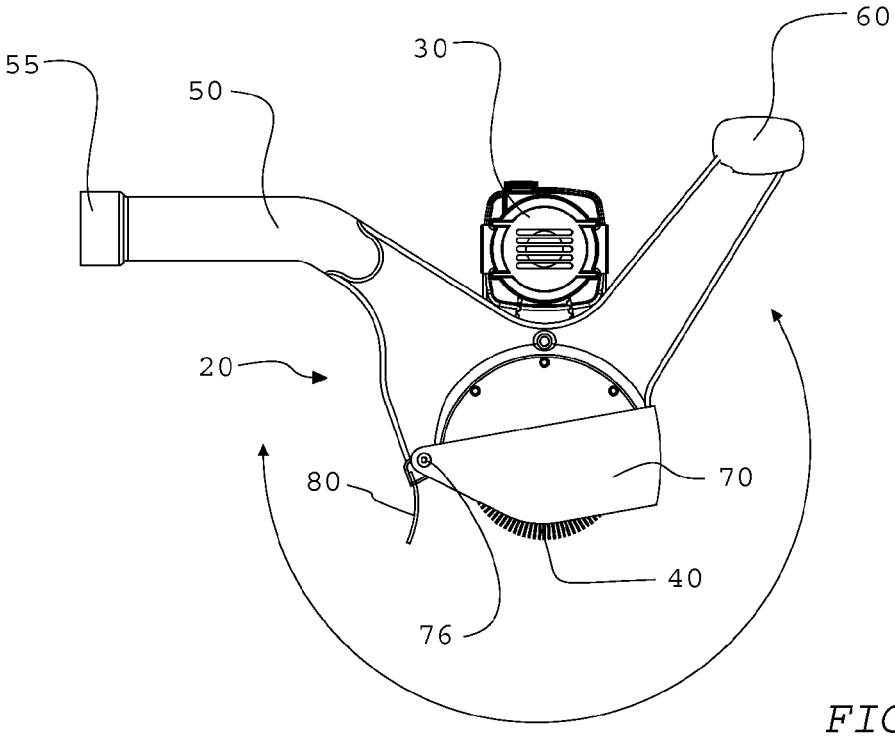
FIG. 6 is a left side elevational view of the apparatus shown in FIG. 1.
Figure 7A:
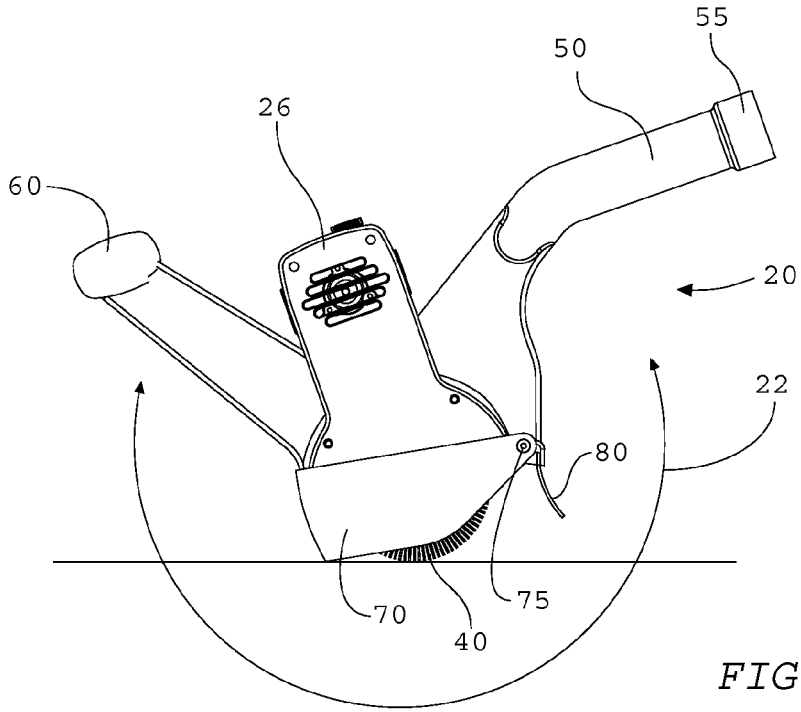
FIG. 7A is a right side elevational view of the apparatus of the present invention pivoting back on a surface.
Figure 7B:
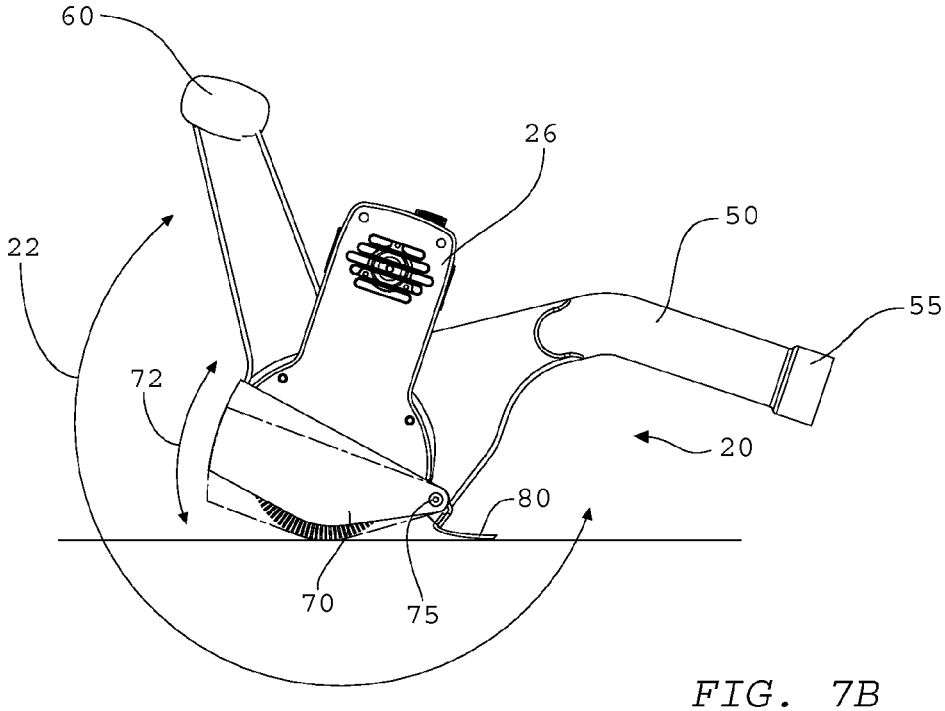
FIG. 7B is a right side elevational view of the apparatus of the present invention pivoting forward on a surface.

Another embodiment of the vacuum capable handle (50) would be to serve as a second guide handle for maneuvering and adjusting the direction and speed of the apparatus (10), as shown in FIG. 1. The apparatus can be maneuvered from front to back (22), as shown in FIGS. 7A and 7B, and side to side (24), as shown in FIG. 4.

An end cap (56) can be installed on the distal end of the vacuum capable handle (55) if use of a vacuum is not desired, as shown in FIG. 1. Once the end cap (56) is in place, the resulting debris is simply scattered around the user's work area, similar to a typical angle grinder.

A rear debris guard (80) is removably attached to the frame (20) beneath the vacuum handle (50), as shown in FIG. 3. The rear debris guard (80) is preferably made of rubber so that it is flexible and will not disturb the surface being prepared by the roller (40). The rear guard (80) is inserted into the frame by sliding the upper portion of the rear debris guard (85) into a slot (28) on the frame (20). In one embodiment, the rear guard (80) would be secured in the frame by attaching each of the end caps (25, 26) to the frame (20).

A front debris guard (70) is connected to the frame (20) beneath the guide handle (60) by means of fasteners or bolts so that it is removable, as shown in FIG. 2. In the preferred embodiment, the front debris guard (70) is pivotally connected to the frame (20) at two points (75, 76) by means of a connecting fastener, bolt or screw so that a limited angle of rotation (72) is allowed. The front debris guard (70) would pivot to accommodate the shape of the surface being prepared in order to prevent debris from injuring the user, as shown in FIGS. 7A and 7B. A notch (78) is located on the front debris guard (70), as shown in FIG. 2, in order to accommodate the pivoting motion along the length of the guide handle (60). The front debris guard (70) would also serve to catch debris to be collected by the vacuum line (58) when the vacuum guide handle (50) is utilized. In the preferred embodiment, the front debris guard (70) would be comprised of transparent impact resistant material. The front debris guard (70) could also be made of plastic.

While specific embodiments of the present invention have been shown and described in detail, it is to be understood that the present disclosure has been made by way of example only and that numerous changes in the detailed constructed and the combination and arrangement of parts may be utilized without departing from the spirit and scope of the invention as hereinafter claimed.

What is claimed is:

1. A surface preparation apparatus comprising:

a frame;

a hollow semi-circular shaped housing member connected to said frame;

a drive housing connected to said housing member a motor secured to said drive housing aligned directly over said hollow semi-circular shaped housing member;

a roller rotatably positioned inside of the semi-circular shaped housing member in communication with said motor;

a front guide handle extending from said frame;

a rear guide handle extending from and in communication with said frame;

a front debris guard pivotally secured to said housing member;

a flexible rear debris guard secure to said housing member and a source of power for said motor.

2. The surface preparation apparatus of claim 1 wherein the roller can be removable.

3. The surface preparation apparatus of claim 1, wherein the frame is preferable constructed out of metal.

4. The surface preparation apparatus of claim 1, wherein said source of power for said motor is electricity.

5. The surface preparation apparatus of claim 1, wherein said rear guide handle comprising:

a vacuum capable line having an opening at the distal end to accommodate a vacuum line; and an end cap being removably connected to the distal end of the rear guide handle.

6. The surface preparation apparatus of claim 1, wherein the front debris guard has an opening to accommodate pivotal movement of the front debris guard against the length of the front guide handle.

7. The surface preparation apparatus of claim 1, wherein the front debris guard is comprised of impact resistant material.

8. The surface preparation apparatus of claim 1, wherein the rear debris guard is comprised of flexible rubber.

9. The surface preparation apparatus of claim 1 wherein said roller has a roller pulley on end thereof, said motor has a drive pulley in vertical alignment with said roller pulley, a drive belt in communication with said roller and drive pulleys within said drive housing.

* * * * *